US011930897B1

(12) United States Patent
Rudnick

(10) Patent No.: US 11,930,897 B1
(45) **Date of Patent: *Mar. 19, 2024**

(54) CUSTOMIZABLE NECKLACE SYSTEM AND METHOD

(71) Applicant: Catherine Rudnick, Boca Raton, FL (US)

(72) Inventor: Catherine Rudnick, Boca Raton, FL (US)

( * ) Notice: Subject to any disclaimer, the term of this patent is extended or adjusted under 35 U.S.C. 154(b) by 91 days.

This patent is subject to a terminal disclaimer.

(21) Appl. No.: 17/575,835

(22) Filed: Jan. 14, 2022

Related U.S. Application Data

(63) Continuation-in-part of application No. 16/809,140, filed on Mar. 4, 2020, now Pat. No. 11,224,267.

(60) Provisional application No. 62/814,679, filed on Mar. 6, 2019.

(51) Int. Cl.

| | |
|---|---|
| ***A44C 11/00*** | (2006.01) |
| ***A44C 5/20*** | (2006.01) |
| ***A44C 5/22*** | (2006.01) |

(52) U.S. Cl.
CPC ..... *A44C 5/209* (2013.01)

(58) Field of Classification Search
CPC ..... A44C 5/246; A44C 13/00; A44C 15/005; A44C 15/0045; A44C 15/001; A44C 15/00; A44C 5/209; A44C 5/2095; Y10T 24/31; Y10T 24/312; Y10T 24/32; F16B 45/06
See application file for complete search history.

(56) References Cited

U.S. PATENT DOCUMENTS

| | | | | |
|---|---|---|---|---|
| 1,578,940 | A * | 3/1926 | Wacha | A44C 5/209 24/518 |
| 2,521,589 | A * | 9/1950 | Livingston | A44C 5/209 63/3.2 |
| 3,181,217 | A * | 5/1965 | Bohlinger | A44C 5/209 24/116 A |
| 3,323,324 | A * | 6/1967 | Bohlinger | A44C 1/00 63/1.17 |
| 4,530,221 | A * | 7/1985 | Weinberg | A44C 5/209 63/23 |
| 9,173,459 | B2 * | 11/2015 | Gisser | A44C 5/2095 |
| 2019/0357640 | A1 * | 11/2019 | Walsh | A44C 5/209 |

* cited by examiner

*Primary Examiner* — Jack W Lavinder
(74) *Attorney, Agent, or Firm* — John Rizvi; John Rizvi, P.A—The Patent Professor®

(57) ABSTRACT

A customizable necklace comprising a necklace body, a first fastener and a second fastener. The necklace body forms a closed loop. The first fastener is configured to disconnectably and selectively secure to different positions along the necklace body. Similarly, the second fastener is configured to disconnectably and selectively secure to different positions along the necklace body. The customizable necklace system is configured to adopt multiple usage positions, in which the first and second fasteners are attached to the necklace body and to one another forming a first loop and a second loop, wherein the first loop has a different size in each usage position and the second loop has a different size in each usage position.

20 Claims, 10 Drawing Sheets

CUSTOMIZABLE NECKLACE SYSTEM AND METHOD

CROSS-REFERENCE TO RELATED APPLICATION

This application is a Continuation-In-Part of U.S. Non-Provisional patent application Ser. No. 16/809,140, filed on Mar. 4, 2020, which in turn claims the benefit of U.S. Provisional Patent Application No. 62/814,679, filed on Mar. 6, 2019, all of which are incorporated by reference herein in their entirety.

FIELD OF THE INVENTION

The present invention relates generally to a customizable necklace system and method, and more particularly, to a customizable necklace that can carry one or more pendants along the length of a relatively long necklace body that forms a closed loop, and a detachable magnetic fastener that secures two points of the necklace body to one another to form two separate, independently sized and shaped ornamental loops in the necklace body. The detachable fastener can be secured to different points along the necklace body to adjust the diameter and shape of the two separate ornamental loops and the position of the pendants relative to each other, if more than one pendant is included.

BACKGROUND OF THE INVENTION

Generally, a necklace is an article of jewelry that includes a string and a plurality of ornamental members arranged linearly along the length of the string. The string may be fabricated from chain links, a gold strand, a silver strand, a natural filament, a polymer strand, and other strands, cables, and wires known in the jewelry art. The ornamental members may have a bore that enables the string to pass therethrough. Often, the necklace opens and closes at clasped ends that are meant to be worn centered at the nape of a wearer's neck. The necklace may also provide various pendants, stones, and other decorative members that are slidably received on the string. As to the necklace length, shorter necklaces such as chokers, princesses, and matinees are known, which cannot be pulled over the head. Alternatively, necklaces can be of varying, longer lengths allowing the necklaces to be pulled over the head.

Typically, clasps, pulling eyes, and magnets can be used to connect opposite free ends of the necklace together. For example, a pulling eye and a plate can engage each other to fasten and unfasten. Often, a simple friction fit relationship between two opposing metallic members can serve to fasten and unfasten the ends of the necklace. Additionally, such fastening means as plug-in clasps work to clasp with or without decorations added thereto, providing design points so that the a joint can be slid to one side or to the front along the length of the necklace.

Current length-adjustable necklaces do not consistently provide the required ease of length and position adjustability, nor do these articles of jewelry provide the secure attachment means. It would thus be beneficial to have a customizable necklace that could reposition the pendants and change the loop configuration of the necklace body in an ornamental, facilitated, and time-efficient manner.

Accordingly, there is an established need for a customizable necklace system and method that solves at least one of the aforementioned problems.

SUMMARY OF THE INVENTION

The present invention is directed to a customizable necklace system and method. The customizable necklace may carry multiple pendants along the length of a relatively long necklace body that forms a closed loop. A detachable fastener secures two points of the necklace body to one another to form two separate, independently sized and shaped ornamental loops in the necklace body. Each ornamental loop can have a unique diameter and shape. Each pendant can hang from a different region of the ornamental loop. The detachable fastener can be moved along the length of the necklace body to fasten together different points of the closed loop, at the first region, middle region, and second region. This allows for customizable adjustability of the diameter and shape of the two separate ornamental loops, and the position of the pendants relative to each other.

In a first implementation of the invention, a customizable necklace system may include a necklace body, a first fastener, and a second fastener. The necklace body may be formable into a closed loop. The first fastener and second fastener may be configured to disconnectably fasten to one another. At least one of the first and second fasteners may be disconnectably attachable to the necklace body at different positions along the necklace body. The customizable necklace system may be configured to adopt at least two usage configurations in which the first fastener is attached to and carried by the necklace body and the second fastener is attached to and carried by the necklace body at different position along the necklace body than the first fastener. In the usage configurations, the first and second fasteners are fastened to one another dividing the closed loop into a corresponding first loop and second loop. Furthermore, in each usage configuration, at least one of the first fastener and the second fastener may be arranged in a different position along the necklace body relative to the other usage configuration or configurations; in addition, the first loop may have a different size than the size of the first loop corresponding to the other usage configuration or configurations, and the second loop may have a different size than the size of the second loop corresponding to the other usage configuration or configurations. In each usage configuration, the first and second fasteners are disconnectable from one another such that, when disconnected from one another, the first fastener may remain attached to and carried by the necklace body and the second fastener may remain attached to and carried by the necklace body.

In a second aspect, the first and second fasteners may be configured to magnetically fasten to one another.

In another aspect, the first and/or second fastener which is disconnectably attachable to the necklace body may include a clasp configured to disconnectably clasp to the necklace body at different positions along the necklace body.

In another aspect, the first and second fasteners may form an elongated link when disconnectably fastened to one another.

In another aspect, in the at least two usage configurations, the first and second fasteners may be attached to the necklace body at opposite longitudinal ends of the link.

In yet another aspect, in the at least two usage configurations, the first and/or second fasteners which is disconnectably attachable to the necklace body may be clasped to the necklace body at a longitudinal end of the link.

In another aspect, both the first fastener and the second fastener may be disconnectably attachable to the necklace body. Each one of the first and second fasteners may include a respective clasp configured to disconnectably clasp to the necklace body at different positions along the necklace body. In the at least two usage configurations, the first and second fasteners may be clasped to the necklace body at opposite longitudinal ends of the link.

In another aspect, in the at least two usage configurations, the first and second fasteners may be disconnectably fastened to one another at an intermediate longitudinal section of the link.

In another aspect, the first fastener and second fastener may be disconnectably and magnetically fastened to one another at the intermediate longitudinal section of the link.

In yet another aspect, the first fastener and second fastener may include a respective end surface. The end surface of the first fastener may be configured to abut against the end surface of the second fastener when the first and second fasteners are attached to one another.

In another aspect, the end surfaces may be flat.

In another aspect, the customizable necklace system may further include one or more magnets configured to magnetically attach the first fastener to the second fastener. The magnet or magnets may be arranged at the end surface of at least one of the first and second fasteners and flush with the end surface.

In another aspect, the customizable necklace system may further include a first pendant carried by the necklace body at a first position along the necklace body. In a first usage configuration of the at least two usage configurations, the first pendant may be arranged in the first loop corresponding to the first usage configuration; in a second usage configuration of the at least two usage configurations, the first pendant may be arranged in the first loop corresponding to the second usage configuration.

In yet another aspect, the customizable necklace system may further include a second pendant carried by the necklace body at a second position along the necklace body different than the first position. In the first usage configuration of the at least two usage configurations, the second pendant may be arranged in the second loop corresponding to the first usage configuration; in the second usage configuration of the at least two usage configurations, the second pendant may be arranged in the second loop corresponding to the second usage configuration.

In another aspect, the second pendant may be different than the first pendant.

In another aspect, the necklace body may include at least one of a string, a cord, a strap, a band, a chain, and a strand.

In another aspect, the necklace body may include a plurality of ornamental members arranged linearly along a length of the necklace body.

In yet another aspect, the plurality of ornamental members may include at least one of a pearl, a bead, a precious stone, a semi-precious stone, a gold member, a silver member, and a stainless steel member.

In yet another implementation of the invention, a method of customizing a necklace comprises the steps of:

arranging a relatively long necklace body to form a closed loop, the loop being defined by a first region, a middle region, and a second region, each region being substantially equal in length;

joining a first pendant to the necklace body, the first pendant being slidably displaceable to any region along the length of the necklace body, whereby a first neutral position of the first pendant is in the first region of the closed loop;

joining a second pendant to the necklace body, the second pendant being slidably displaceable to any region along the length of the necklace body, whereby a second neutral position of the second pendant is in the second region of the closed loop;

slidably displacing the first and second pendant along the length of the necklace body, whereby a first neutral position of the first pendant is in the first region of the closed loop, and whereby a second neutral position of the second pendant is in the second region of the closed loop;

attaching a first fastener to the first region of the closed loop of the necklace body, the first fastener comprising a first clasp joined to a first magnet;

attaching a second fastener to the first region of the closed loop of the necklace body, the second fastener comprising a first clasp joined to a first magnet, whereby two separate ornamental loops comprises a first ornamental loop carrying the first pendant, and a second ornamental loop carrying the second pendant, whereby the first ornamental loop is smaller than the second ornamental loop;

attaching the first fastener to the second region of the closed loop of the necklace body;

attaching the second fastener to the second region of the closed loop of the necklace body, whereby two separate ornamental loops comprises the first ornamental loop carrying the first pendant, and the second ornamental loop carrying the second pendant, whereby the first ornamental loop is larger than the second ornamental loop;

attaching the first fastener to the third region of the closed loop of the necklace body;

attaching the second fastener to the third region of the closed loop of the necklace body, whereby two separate ornamental loops comprises the first ornamental loop carrying the first pendant, and the second ornamental loop carrying the second pendant, whereby the first ornamental loop is substantially larger than the second ornamental loop; and detaching the first and second fasteners from the necklace body, whereby the first pendant rests in a first neutral position in the first region of the closed loop, and the second pendant rests in a second neutral position in the second region of the closed loop.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 6:
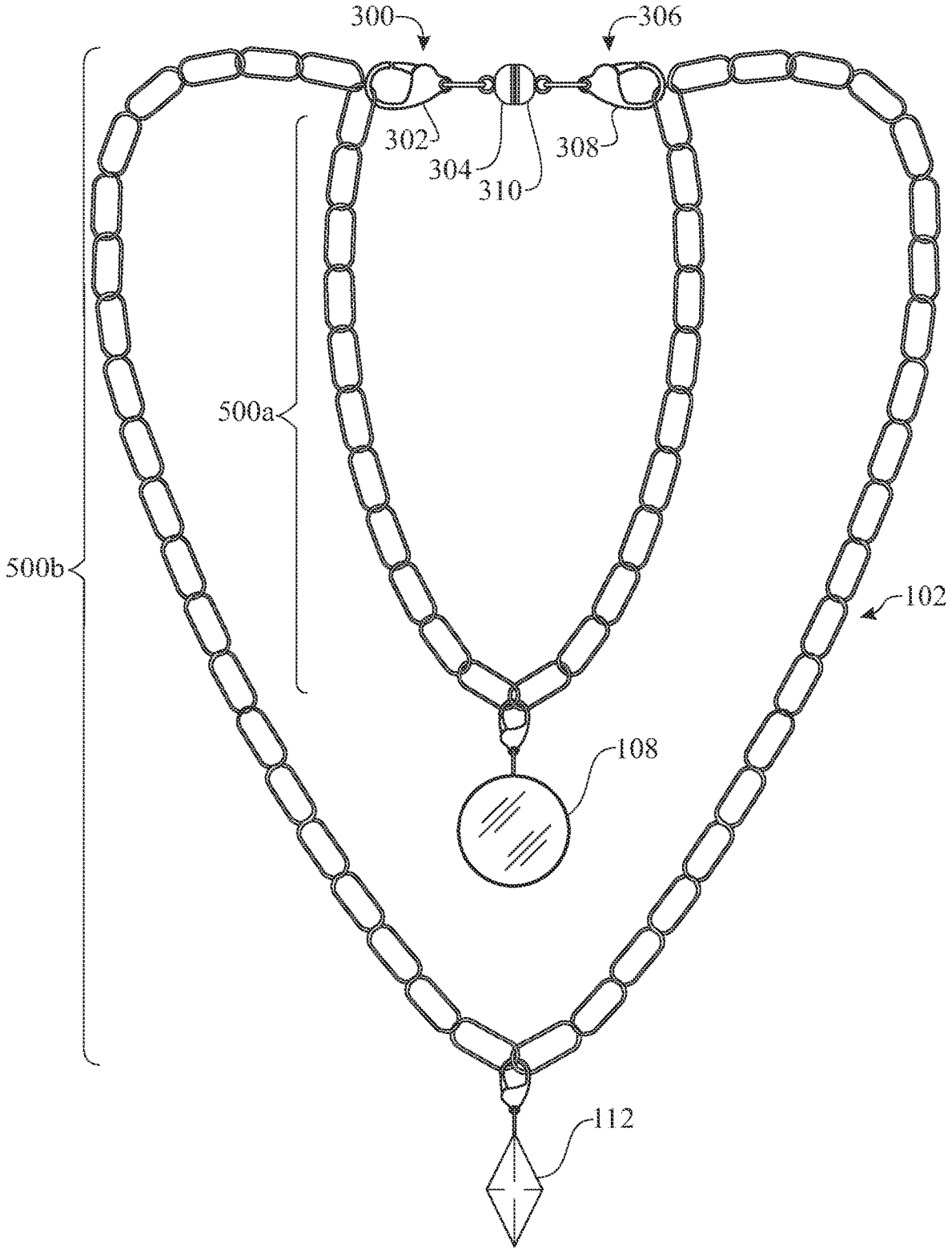
FIG. 6 presents a front view of the first and second fasteners of FIG. 3 attached to the first region of the closed loop of FIG. 1 and dividing the closed loop into two separate ornamental loops comprising a first ornamental loop carrying the first pendant and a second ornamental loop carrying the second pendant, whereby the first ornamental loop is smaller than the second ornamental loop of the present invention.

Shown throughout the figures, and with reference initially to FIG. 6, the present invention is directed toward a customizable necklace system 100 that may carry one or more pendants 108, 112 along the length of a flexible, relatively long necklace body 102. The invention is also directed to a method of operation, use or customization of the customizable necklace. The customizable necklace system 100 utilizes a pair of detachable fasteners 300, 306, best shown in FIG. 3, for detachably attaching two points of the necklace body 102 together, so as to form two customizable separate ornamental loops that customize the necklace to a desired shape, dimension, and pendant position, as will be described in detail hereinafter.

Figure 1:
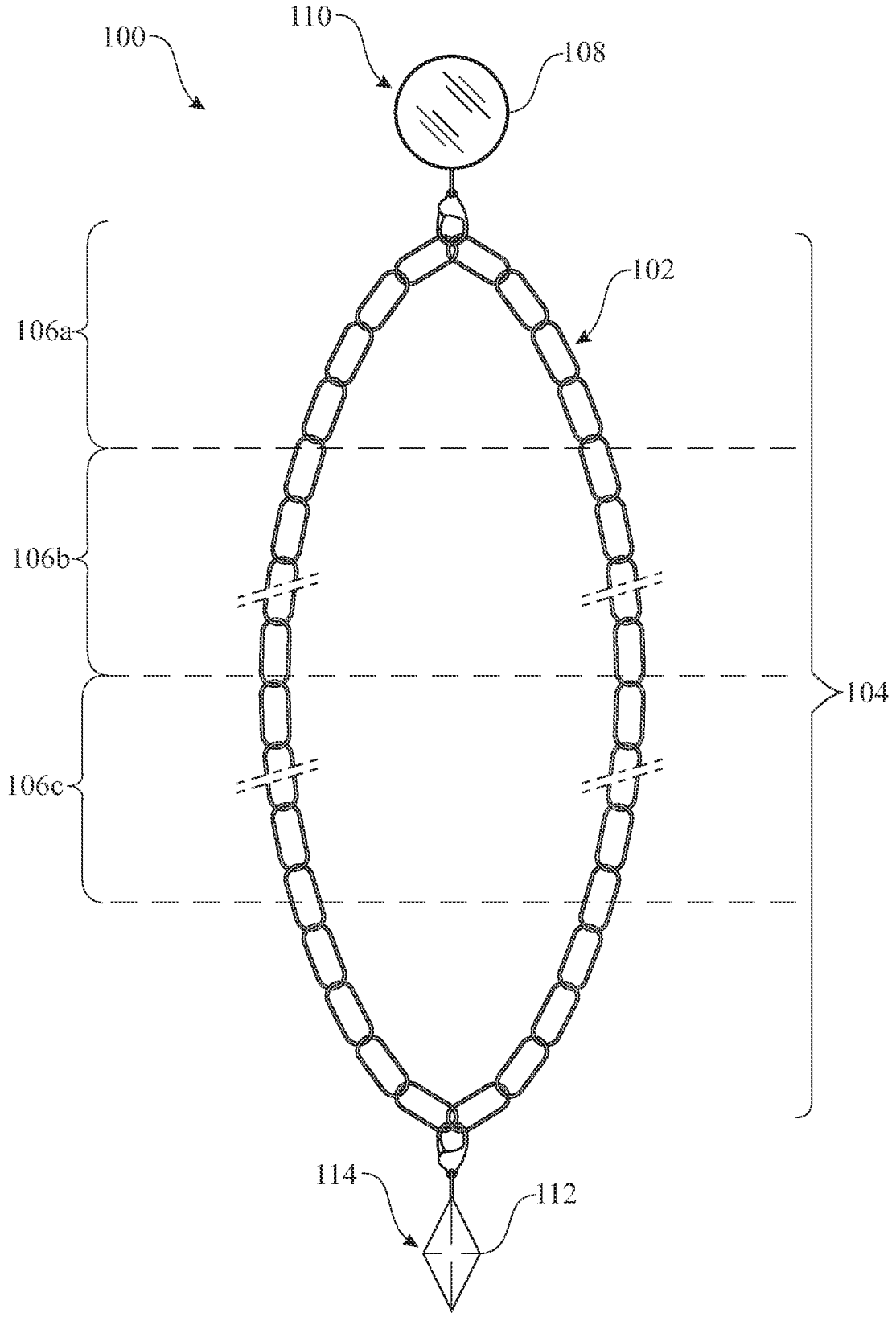
FIG. 1 presents a front view showing a customizable necklace with a first pendant and a second pendant in accordance with an illustrative embodiment of the present invention, the necklace body forming into a closed loop, wherein first and second pendants are carried by first and second regions of the necklace body, respectively.

Referring to FIG. 1, the customizable necklace system 100 comprises the aforementioned relatively long necklace body 102 that forms a closed loop 104. In some embodiments of the invention, the necklace body 102 may come as a closed loop 104; for instance, in the present embodiment, the necklace body 102 is a chain that is formed or configured as a closed loop. In other embodiments, the necklace body 102 may be an elongate piece that may be flexed and secured into a closed loop, such as by a fastener. In different embodiments of the invention, the necklace body 102 may include one or more elongate bodies such as, but not limited to, a string, cord, strap, band, chain, strand, or combination thereof. The one or more elongate bodies forming the necklace body 102 may be fabricated, or include, for instance and without limitation, chain links, a gold strand, a silver strand, a natural filament, a polymer or other strand, a cable, or a wire or other material known in the jewelry art. As a non-limiting example, the figures shown herein present a necklace body 102 in the form of a chain comprised of chain links.

In some embodiments, the necklace body 102 may further include one or more ornamental members arranged linearly along the length of the necklace body 102. The ornamental members may have a bore that enables passage through a string or other elongate body comprised in the necklace body 102. In some embodiments, the ornamental members may include, without limitation, pearls, beads, precious stones, semi-precious stones, a gold member, a silver member, and a stainless steel member. In one embodiment, the string carries multiple ornamental members in an adjacent, side-by-side relationship.

Figure 2:
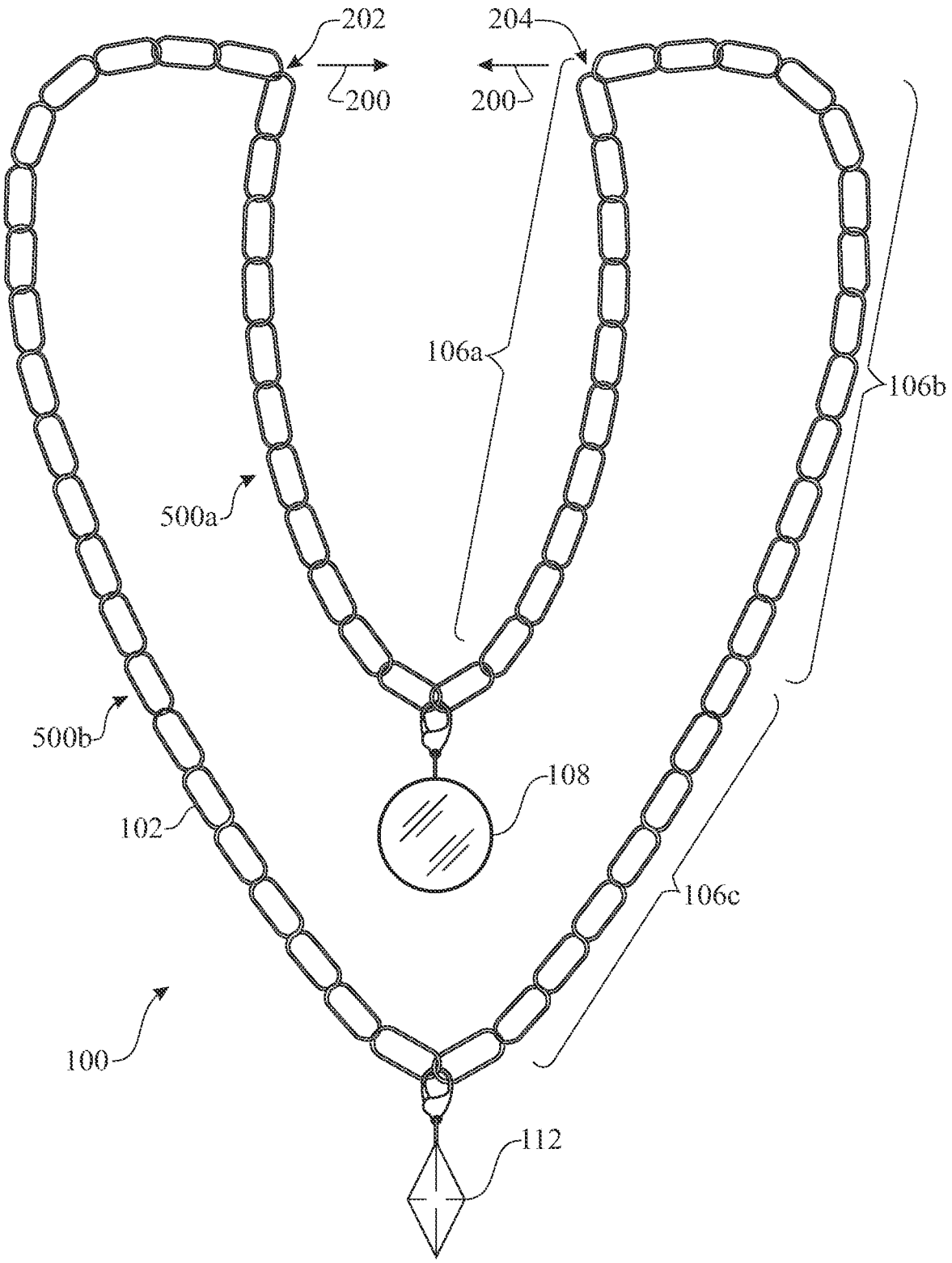
FIG. 2 presents a front view of the customizable necklace system of FIG. 1, with opposite points of the first region of the necklace body being drawn towards each other.

Turning now to FIG. 2, the necklace body 102 is shown in a first configuration in which, when forming the closed loop 104, the necklace body 102 is defined by a first region 106*a*, a middle region 106*b*, and a second region 106*c* that may be equal or different in length. The regions 106*a*, 106*b*, 106*c* may be such that, when the closed loop 104 is arranged over a wearer's neck and pulled taut, the first region 106*a* is proximally located to the head of the necklace wearer, while the middle region 106*b* is distally located from the head of the necklace wearer and the second region 106*c* is located distally from the middle region 106*b*.

As mentioned heretofore, the customizable necklace system 100 may include one or more pendants carried by, joined with, or suspended from the necklace body 102. In the event of including more than one pendant, the pendants may be the same or different, i.e. may be visually the same (look the same) or different (look different). In a non-limiting example of the invention, the customizable necklace system 100 shown herein includes two pendants 108, 112. The first pendant 108 may include, without limitation, a metal ornament. The second pendant 112 may be different than the first pendant 108; for example, the second pendant 112 may include, without limitation, a crystal.

The one or more pendants comprised in the customizable necklace system can be fixed or, alternatively, slidably displaceable or otherwise repositionable anywhere along the length of the necklace body (e.g. disconnectable from the necklace body and selectively reconnectable to different positions along the necklace body). For instance, in the present non-limiting example, the pendants 108, 112 are joined with the necklace body 102 by a respective fastener that may be selectively attached to the different links comprised in the chain at selected positions in dependence of the wearer's needs. It must be noted that, while the fastener shown herein is a clasp ring, alternative or additional fasteners or connecting means known in the art of jewelry may be used to fixedly, slidably or repositionably join the pendants 108, 112 with the necklace body 102.

The one or more pendants 108, 112 can be worn centered or non-centered, as desired by the wearer, for instance and without limitation. As shown in FIG. 1, in a first neutral position 110, the first pendant 108 rests in the first region 106*a* of the closed loop 104; in a second neutral position 114, the second pendant 112 rests in the second region 106*c* of the closed loop 104. As will be discussed in greater detail below, in accordance with the invention, the position of the one or more pendants 108, 112 relative to the wearer's neck can be adjusted through manipulation of the closed loop 104 formed by the necklace body 102 to vary the length of the two ornamental loops 500*a*, 500*b*, and by optional displacement or repositioning of the pendants 108, 112 along the necklace body 102.

Turning now to FIG. 2, the customizable necklace system 100 is unique in that the closed loop 104 that is formed by the necklace body 102 can be attached at opposing points along any of the three aforementioned regions 106*a*, 106*b*, 106*c*. For this purpose, a user selects any opposing points 202, 204 along the necklace body 102 and brings them towards one another as indicated by arrows 200. Such movement creates a unique arrangement of two separate ornamental loops 500*a*, 500*b*. Each ornamental loop 500*a*, 500*b* can be adjustably sized and shaped in dependence of the location of the connection points 202, 204 along the necklace body 102. In some embodiments, the ornamental loops 500*a*, 500*b* can also carry their respective pendants 108, 112 at adjustable positions relative to each other based on the connection points 202, 204 along the necklace body 102. In this manner, the length and shape of each ornamental loop 500*a*, 500*b*, and the position of the pendants 500*a*, 500*b* along each ornamental loop is fully customizable through detachable attachment of the closed loop 104 at different regions 106*a*, 106*b*, 106*c* thereof. It must be noted that the wearer may also choose to form the ornamental loops 500*a*, 500*b* with one or both loops devoid of pendants or including more than one pendant.

Figure 3:
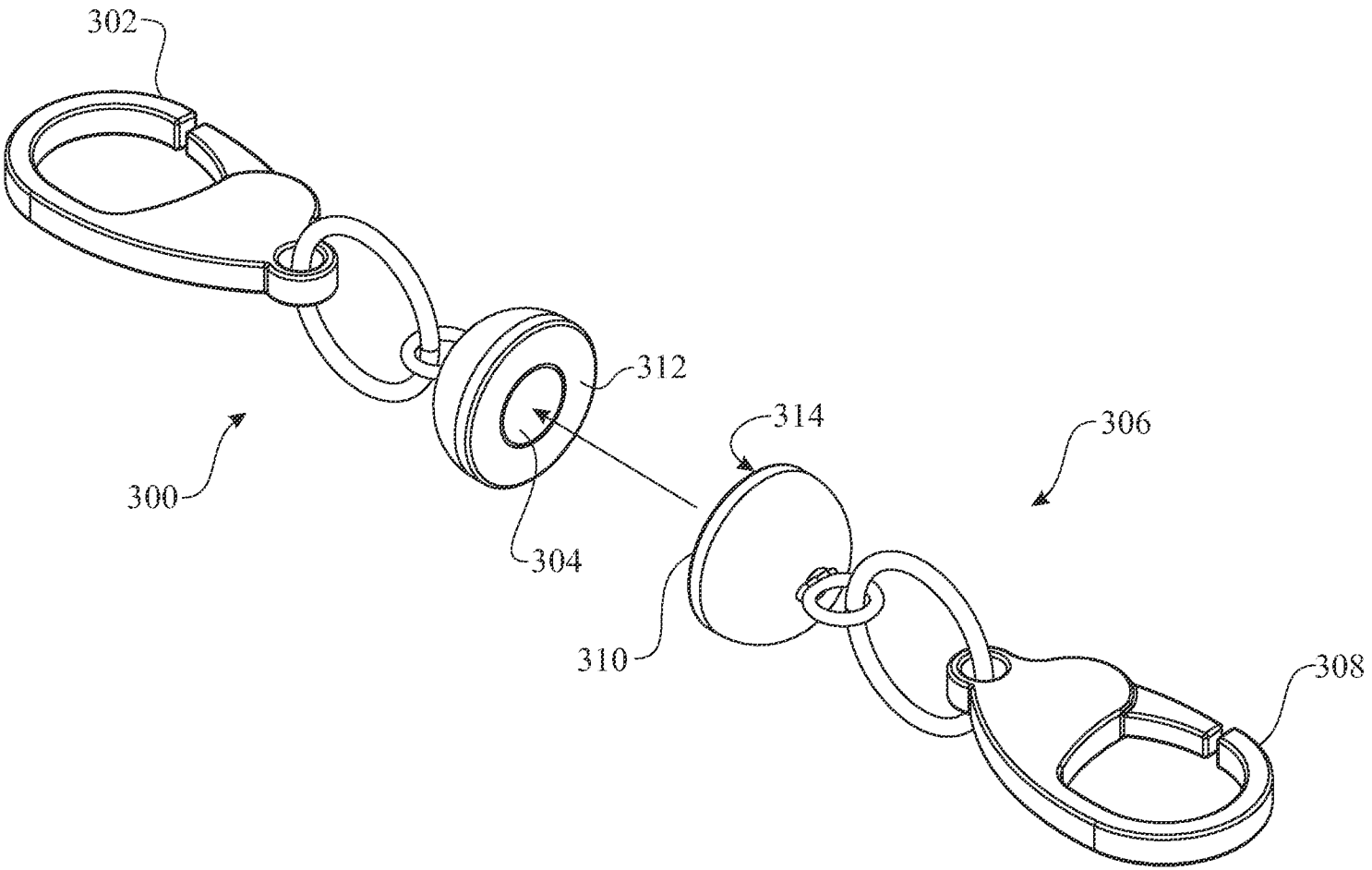
FIG. 3 presents a perspective view showing a first fastener detached from a second fastener in accordance with an illustrative embodiment of the present invention.
Figure 4:
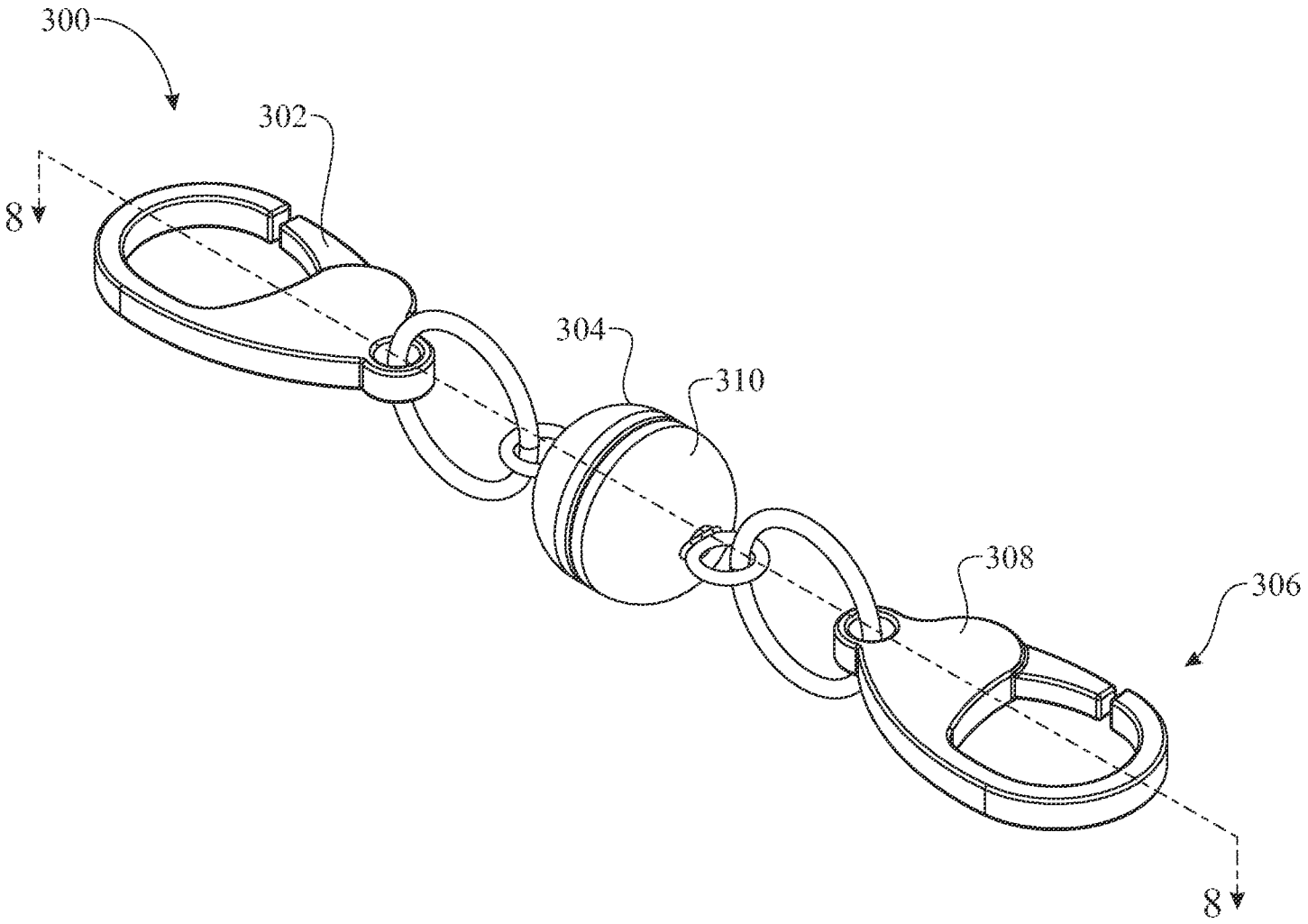
FIG. 4 presents a perspective view of the fasteners of FIG. 3, showing the first fastener connected to the second fastener.
Figure 5:
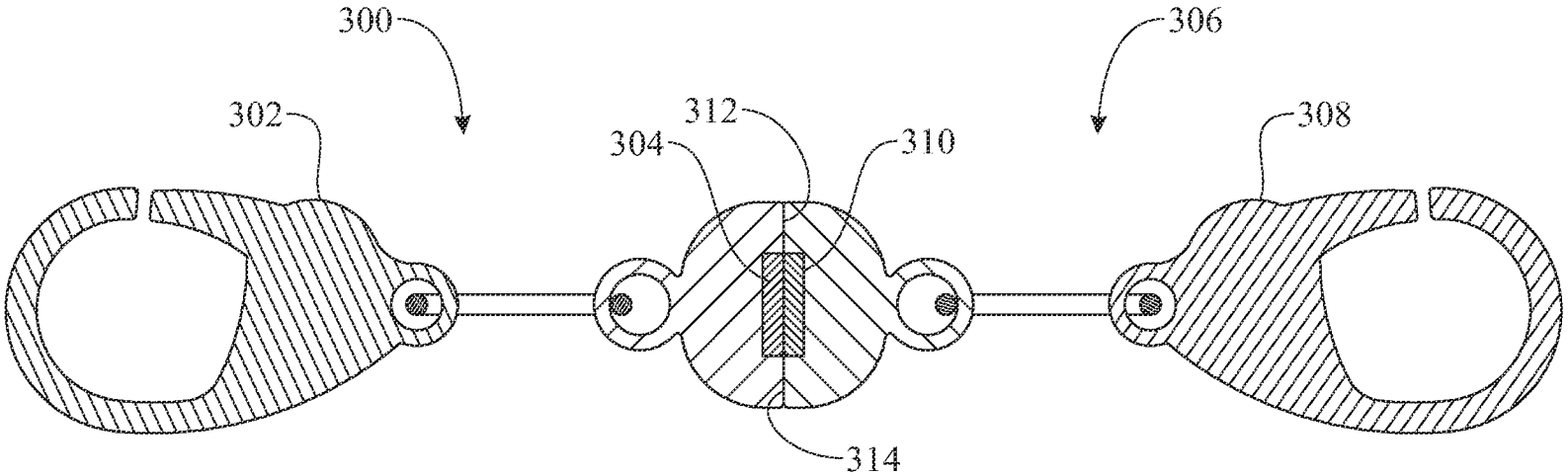
FIG. 5 presents a cross-sectional, top plan view of the first and second fasteners of FIG. 4, the section taken along section plane 8-8 indicated in FIG. 4, detailing a magnetic attachment between the fasteners.

As mentioned heretofore, and referring now to FIGS. 3-5, the customizable necklace system 100 utilizes a pair of detachable fasteners 300, 306 for detachably attaching the two points 202, 204 of the necklace body 102 to one another to secure the first and second ornamental loops 500*a*, 500*b*. The detachable fasteners 300, 306, which may be equal, similar or different to one another, are disconnectably attachable to the necklace body 102 (i.e. may detachably attach to different points along the necklace body 102 as selected by the wearer) and also disconnectably attachable to one another. For instance, in some embodiments, such as the present embodiment, the first fastener 300 and second fastener 306 may disconnectably attach to the necklace body 102 via a similar fastening mechanism. The similar fastening system may consist, for instance and without limitation, of a first clasp 302 and a second clasp 308 comprised in the first and second fasteners 300 and 306, respectively. In one non-limiting embodiment, the first clasp 302 and/or second clasp 308 are spring-loaded to remain in a naturally closed position while attached to the necklace body 102 until a force is applied to urge the spring-loaded first clasp 302 and/or second clasp 308 to an open position for attachment or detachment to the necklace body 102. However, in other embodiments, the first clasp 302 and/or second clasp 308 may use other clasping means known in the art, such as friction fit relationships, and hinged jewelry brackets.

As illustrated in FIGS. 3-5, the first and second fasteners 300 and 306 may disconnectably connect to one another, for instance and without limitation, by magnetic attachment between a first magnet 304 and a second magnet 310 comprised in the first and second fasteners 300, 306, respectively. As shown in FIG. 5, the second magnet 310 of the second fastener 306 is detachably attachable to the first magnet 304 of the first fastener 300. Alternative embodiments are contemplated without departing from the scope of the present disclosure. For instance, one of the first and second fasteners 300 and 306 may disconnectably connect to one another by magnetic attachment between a magnet and a ferromagnetic material comprised in the first and second fasteners 300, 306. This magnetic connectivity allows the first and second fasteners 300, 306 to magnetically attract each other causing the two points 202, 204 of the necklace body 102 to be drawn inwardly to easily form two separate ornamental loops 500*a*, 500*b*, thus facilitating customization of the customizable necklace system 100 by the user. Notwithstanding, alternative embodiments are contemplated in which the first and second fasteners may be disconnectably connectable to one another by alternative or additional fasteners such as, but not limited to, a threaded connection, a snap fit, a friction fit, a bayonet fit, or a hook-type connection.

The first and second fasteners 300 and 306 are connectable to one another to jointly form a link, best shown in FIGS. 4 and 6, configured to interconnect two points 202, 204 of the necklace body 102. As shown, the link formed by the interconnected first and second fasteners 300 and 306 is elongated in shape along a longitudinal direction. In some embodiments, such as the present embodiment, the first and second clasps 302 and 308 (or other means for fastening the first and second fasteners 300 and 306 to the necklace body 102) are located at opposite longitudinal ends of the elongated link. In turn, the magnets 304, 310 (or other means for fastening the first and second fasteners 300 and 306 to one another) are located at an intermediate longitudinal area of the joint link. This configuration facilitates forming or separating the link while wearing the necklace 102, in order to secure or remove the necklace 102 as needed, without requiring another person's assistance.

In some embodiments, such as the depicted embodiment, as shown in FIGS. 3-5, the first fastener 300 and second fastener 306 may include a respective end surface 312 and 314. As best shown in FIG. 5, the end surface 312 of the first fastener 300 may be configured to abut against the end surface 314 of the second fastener 306 when the first and second fasteners 300 and 306 are attached to one another. In some embodiments, the end surfaces 312, 314 may be flat, and may flatly rest against one another, contributing to stabilize the first fastener 300 and second fastener 306 against one another. The one or more magnets 304, 310 configured to magnetically attach the first fastener 300 to the second fastener 306 may be arranged at the end surface 312 and 314 of at least one of the first and second fasteners 300 and 306, and may be flush with said end surface 312, 314, to further stabilize the first fastener 300 and second fastener 306 against one another when connected to each other. For instance, in the illustrated embodiment, the magnet 304 of the first fastener 300 is flush with the end surface 312, and the magnet 310 of the second fastener 306 is flush with the end surface 314.

In summary, and with reference to the present embodiment, the pair of clasps 302, 308 on the fasteners 300, 306 may detachably attach to different points of the necklace body 102. The pair of magnetic fasteners 300, 306 may then easily and conveniently interconnect the two points 202, 204 with each other to form two customizable ornamental loops 500*a*, 500*b*. By adjusting the position of points 202, 204, the user may customize the size of each ornamental loop 500*a*, 500*b*, as well as the appearance of each ornamental loop 500*a*, 500*b* (for instance, in case the necklace body 102 has beads or other different ornamental elements disposed randomly or irregularly along the necklace body 102). The user may optionally place first pendant 108 and/or second pendant 112 at customizable positions in relation to each other.

Figure 7:
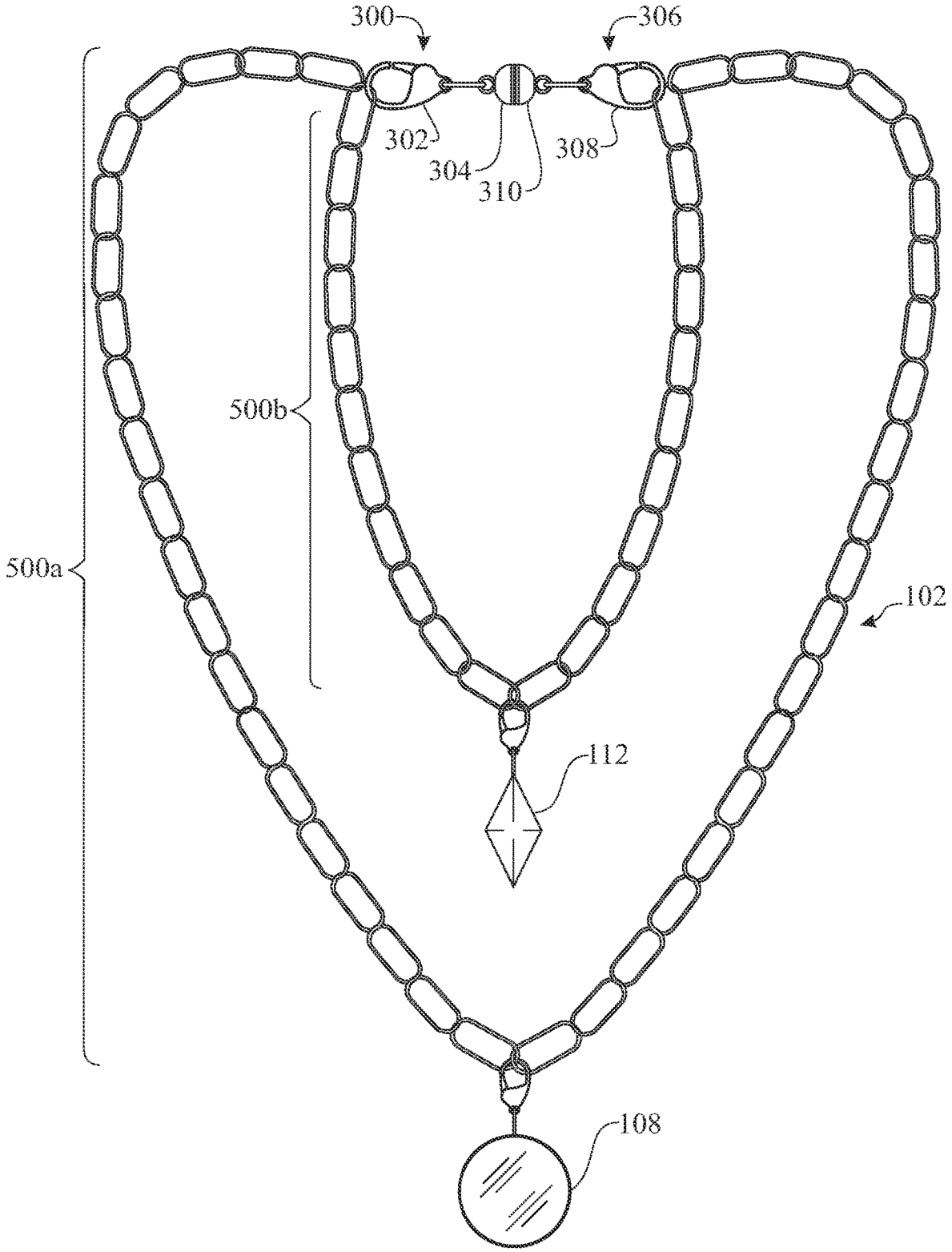
FIG. 7 presents a front view of the first and second fasteners of FIG. 3 attached to the middle region of the closed loop of FIG. 1 and dividing the closed loop into two separate ornamental loops comprising a first ornamental loop carrying the first pendant and a second ornamental loop carrying the second pendant, whereby the first ornamental loop is larger than the second ornamental loop.
Figure 8:
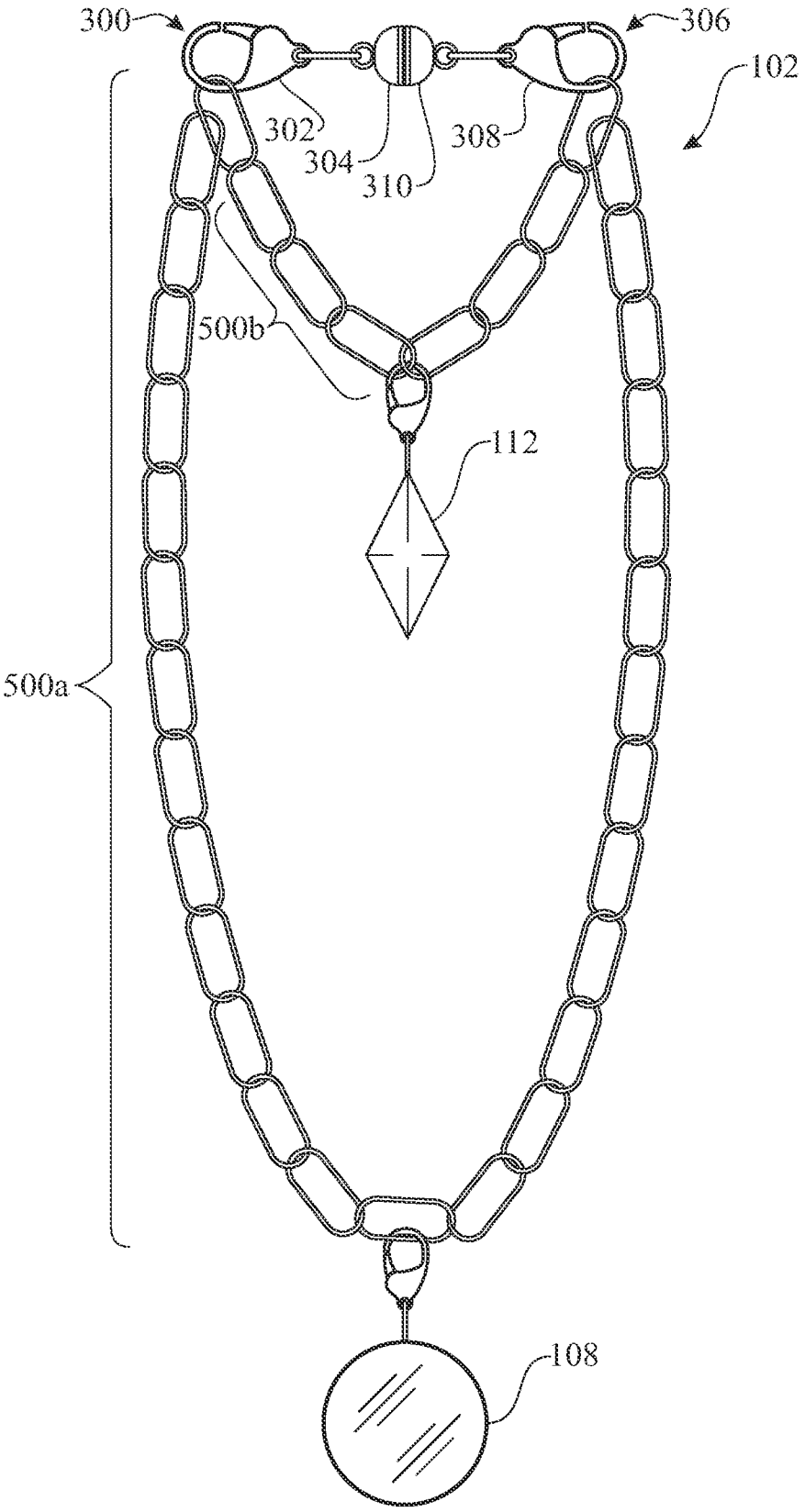
FIG. 8 presents a front view of the first and second fasteners of FIG. 3 attached to the second region of the closed loop of FIG. 1 and dividing the closed loop into yet another two separate ornamental loops, the loops comprising a first ornamental loop carrying the first pendant and a second ornamental loop carrying the second pendant, whereby the first ornamental loop is substantially larger than the second ornamental loop.

The illustrations of FIGS. 6-8 show three adjustment examples, in which the diameter and shape of the ornamental loops 500*a*, 500*b* are varied based on the connectivity of the clasps 302, 304 to the region and specific point on the necklace body 102. Furthermore, in these examples, the position of the pendants 108, 112 is affected by the configuration of the ornamental loops. Thus, the pendants can be moved around and positioned anywhere on the necklace body 102. Furthermore, the clasps 302, 304 on the first and second fastener 300 and 306 can be secured to different points along the necklace body 102 to style the customizable necklace system 100 in different ways by positioning the first and second pendant 108 and 112 to a desired location on the necklace body 102. This creates a myriad of combinations of customizable necklaces. Furthermore, it must be noted that the necklace body 102, and optionally one or more of the pendants 108 and 112, may be also worn in a normal, single-loop configuration (FIG. 1).

Thus, each ornamental loop can have a unique diameter and shape, and each pendant 108, 112 can hang from a different region of the necklace body 102. The first and second fasteners 300, 306 can be secured to different points of the necklace body 102, such as at the first region 106*a*, middle region 106*b*, and second region 106*c*, to adjust the diameter and shape of the two separate ornamental loops 500*a*, 500*b* and the position of the pendants 108, 112 relative to each other.

For example, as shown in FIG. 6, the first and second fasteners 300, 306 can attach to the first region 106*a* of the loop, whereby the two separate ornamental loops 500*a*, 500*b* are constituted by a first ornamental loop 500*a* carrying the first pendant 108 and a second ornamental loop 500*b* carrying the second pendant 112. In this arrangement, the first ornamental loop 500*a* is smaller than the second ornamental loop 500*b*. This configuration is desirable if the wearer wants the first pendant 108 to hang from a shorter ornamental loop 500*a* and the second pendant 112 to hang from a longer ornamental loop 500*b*, for which the wearer will position and attach the clasps 302, 308 accordingly.

The illustration of FIG. 7 shows an alternative customization of the customizable necklace system 100, in which the first and second fastener 300 and 306 attach to the middle region 106*b* of the loop. The two separate ornamental loops are constituted the first ornamental loop 500*a* carrying the first pendant 108 and the second ornamental loop 500*b* carrying the second pendant, whereby the first ornamental loop 500*a* is larger than the second ornamental loop 500*b*. In this arrangement, the wearer is seeking the opposite look to that of the previous figure, for which they have reattached the clasps 302, 308 in the appropriate position on the necklace body 102.

In yet another exemplary configuration, shown in FIG. 8, the first and second fasteners 300, 306 attach to the second region 106*c* of the closed loop 104. The two distinct and separate ornamental loops 500*a*, 500*b* are constituted by a first ornamental loop 500*a* carrying the first pendant 108, and a second ornamental loop 500*b* carrying the second pendant 112, where the first ornamental loop 500*a* is now substantially larger than the second ornamental loop 500*b*, so that the first ornamental loop 500*a* is configured as a choker while the second ornamental loop 500*b* is now a substantially long necklace. In order to reach this arrangement, the wearer has attached the clasps 302, 308 to a specific point in the second region 106*c* to meet the user's aesthetical goal.

In yet another arrangement of clasps 302, 308 along the necklace body 102, the wearer may hang the first and second pendants 108, 112 at the same level, and will reattach the clasps 302, 308 accordingly.

It is also significant to note that the diameter and shape of the ornamental loops 500*a*, 500*b*, and the position of the pendants 108, 112, can be altered slightly by moving the connection points of the clasps 302, 308 within the same region 106*b*. In some embodiments, the arrangement can also be changed by sliding or otherwise repositioning the pendants 108, 112 along their respective ornamental loops. The arrangement can also be adjusted by connecting the clasps 302, 308 between the first region 106*a* and middle region 106*b*, and between the middle region 106*b* and second region 106*c*.

In operation, an exemplary method for customizing a customizable necklace system 100 comprises an initial step of arranging a relatively long necklace body 102 to form a closed loop 104, the loop being defined by a first region 106*a*, a middle region 106*b*, and a second region 106*c*, each region being substantially equal in length. The method may further comprise a step of joining a first pendant to the necklace body 102, the first pendant being optionally slidably displaceable, or otherwise repositionable, to any region along the length of the necklace body 102, whereby a first neutral position of the first pendant is in the first region 106*a* of the closed loop 104.

Another step includes joining a second pendant to the necklace body 102, the second pendant being slidably displaceable to any region along the length of the necklace body 102, whereby a second neutral position of the second pendant is in the second region 106*c* of the closed loop 104. In some embodiments, a step comprises slidably displacing the first and second pendant along the length of the necklace body 102, whereby a first neutral position of the first pendant is in the first region 106*a* of the closed loop 104, and whereby a second neutral position of the second pendant is in the second region 106*c* of the closed loop 104.

In some embodiments, a step includes attaching a first fastener to the first region 106*a* of the closed loop 104 of the necklace body 102, the first fastener comprising a first clasp joined to a first magnet. Another step may include attaching a second fastener to the first region 106*a* of the closed loop 104 of the necklace body 102, the second fastener comprising a first clasp joined to a first magnet, whereby two separate ornamental loops comprises a first ornamental loop carrying the first pendant, and a second ornamental loop carrying the second pendant, whereby the first ornamental loop is smaller than the second ornamental loop. A step comprises attaching the first fastener to the middle region of the closed loop 104 of the necklace body 102.

The method may further comprise a step of attaching the second fastener to the middle region of the closed loop 104 of the necklace body 102, whereby two separate ornamental loops comprises the first ornamental loop carrying the first pendant, and the second ornamental loop carrying the second pendant, whereby the first ornamental loop is larger than the second ornamental loop. A step includes attaching the first fastener to the second region 106*c* of the closed loop 104 of the necklace body 102.

Another step comprises attaching the second fastener to the second region 106*c* of the closed loop 104 of the necklace body 102, whereby two separate ornamental loops comprises the first ornamental loop carrying the first pendant, and the second ornamental loop carrying the second pendant, whereby the first ornamental loop is substantially larger than the second ornamental loop. A final step includes detaching the first and second fasteners from the necklace body 102, whereby the first pendant rests in a first neutral position in the first region 106*a* of the closed loop 104, and the second pendant rests in a second neutral position in the second region 106*c* of the closed loop 104.

Figure 9:
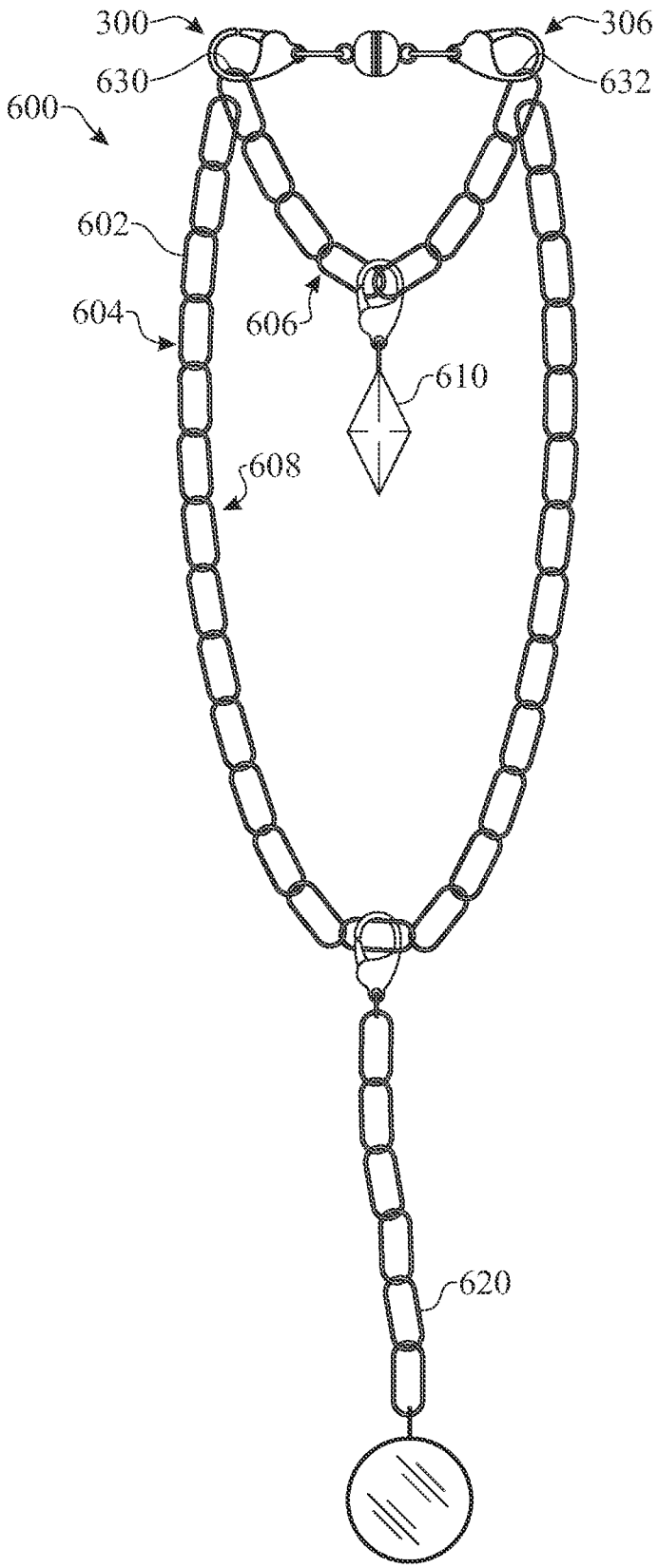
FIG. 9 presents a front view of a customizable necklace system in accordance with a further embodiment of the invention, the customizable necklace system including two slidable and disconnectable pendants, one of the pendants comprising an elongated chain or body.

The illustration of FIG. 9 shows a customizable necklace system 600 in accordance with a further embodiment of the invention. Similarly to previous embodiments, the customizable necklace system 600 includes a necklace body 602, and first fastener 300 and second fastener 306 as heretofore described. The necklace body 602 is formable into a closed loop 604. The first fastener 300 and second fastener 306 are configured to disconnectably fasten to one another. At least one of the first and second fasteners 300 and 306, and more preferably both the first and second fasteners 300 and 306 are disconnectably attachable to the necklace body 602 at different positions along the necklace body 602. For instance, in the present embodiment, similarly to previous embodiments, the first fastener 300 is disconnectably attachable to the necklace body 602, and the second fastener 306 is also disconnectably attachable to the necklace body 602, independently or separately to the first fastener 300.

Also similarly to previous embodiments, the customizable necklace system is configured to adopt two or more, different usage configurations. In each usage configuration, the first fastener 300 is attached to and carried by the necklace body 602 and the second fastener 306 is attached to and carried by the necklace body 602 at different position along the necklace body 602 than the first fastener 300. Furthermore, in each usage configuration, the first and second fasteners 300 and 306 are fastened to one another, dividing the closed loop 604 into a corresponding first loop 606 and second loop 608.

The illustration of FIG. 9 shows an example of a usage configuration. As shown, the first and second fasteners 300 and 306 are fastened to one another, dividing the closed loop 604 into a corresponding first loop 606 and second loop 608. In this example, the first and second fasteners 300 and 306 are strategically fastened to the necklace body 602 at respective positions 630 and 632 which allow to obtain a first loop 606 sized significantly smaller than the second loop 608. In alternative usage configurations, one or both of the first and second fasteners 300, 306 may be alternatively fastened to the necklace body 602 at a different position therealong, such that, when the first and second fasteners 300, 306 are attached to one another in the alternative usage configurations, the first and second loops 606 and 608 are sized differently than in the usage configuration of FIG. 9.

Similarly to the previous embodiments, in the different usage configurations, the first and second fasteners 300 and 306 may be non-slidably or non-movably connected to the necklace body 602. For example, the first and second clasps 302 and 308 of the first and second fasteners 300 and 306, respectively, may be clasped to a corresponding link of a chain forming the necklace body 602. Therefore, in the different usage configurations, the first and second fasteners 300 and 306 may maintain their position along the necklace body 602.

Also similarly to previous embodiments, in the different usage configurations (for example, the usage configuration of FIG. 9), the first and second fasteners 300 and 306, which are attached to each other, are disconnectable from one another. When disconnecting the first and second fasteners 300 and 306 from one another, the first fastener 300 remains attached to and carried by the necklace body 602 and the second fastener 306 remains attached to and carried by the necklace body 602. As mentioned, the same effect occurs when disconnecting the first and second fasteners from each other in the usage configurations of the previous embodiments; for example, with reference to the usage configurations of FIGS. 4-6, in these usage configurations, the first and second fasteners 300, 306 are disconnectable from one another, and if disconnected from one another, the first fastener 300 remains attached to and carried by the necklace body 102 and the second fastener 306 remains attached to and carried by the necklace body 102, as shown.

Similarly to previous embodiments, and with continued reference to FIG. 9, the customizable necklace system 600 may include zero to any number of pendants at each one of the first and second loops 606 and 608. For example, as in the previous embodiments, a first pendant 610 may be carried by the necklace body 602 at a first position along the necklace body 602. In a first usage configuration of the at least two usage configurations (for example, in the usage configuration of FIG. 9), the first pendant 610 may be arranged in the first loop 606; in a second usage configuration of the at least two usage configurations (for example, in a usage configuration in which the first loop 606 is larger and the second loop 608 is smaller), the first pendant 610 may be arranged in the (now larger) first loop 606. In some embodiments, also similarly to the previous embodiments, the customizable necklace system 600 may further include a second pendant carried by the necklace body 602 at a second position along the necklace body 602 different than the first position at which the first pendant 610 is located. As in the previous embodiments, in the first usage configuration of the at least two usage configurations (for example, in the usage configuration of FIG. 9, in which the first loop 606 is smaller than the second loop 608), the second pendant 620 may be arranged in the second loop 608; in turn, in the second usage configuration of the at least two usage configurations (for example, in a second configuration having a first loop 606 larger than the second loop 608), the second pendant 620 may be arranged in the (now larger) second loop 608. Thus, as with the previous embodiments, as the user adjusts the position of the first and second fasteners 300, 306 along the necklace body 602, and thus resizes the first and second loops 606, 608, the loop at which each pendant (if any) is located may be re-sized from small to large relative to the other loop. In embodiments comprising more than one pendant, such as first and second pendants 610, 620, the pendants may be different from one another, increasing the number of selectively adoptable aesthetic configurations.

Figure 10:
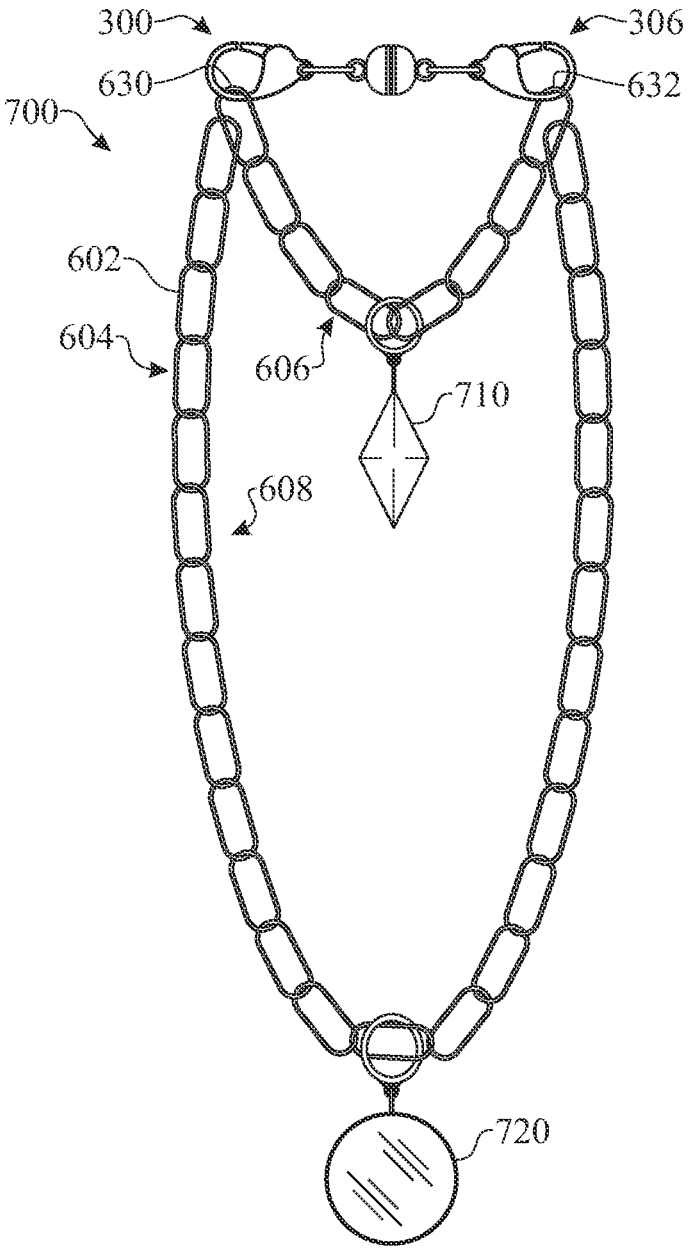
FIG. 10 presents a front view of a customizable necklace system in accordance with a further embodiment of the invention, the customizable necklace system including two slidable and non-disconnectable pendants.

In different embodiments, any one of the available pendants may be disconnectably or non-disconnectably attached to the necklace body. Alternatively or additionally, any one of the available pendants may be slidably or non-slidably attached to the necklace body. For example, in the embodiment of FIGS. 1, 2 and 6-8, both the first pendant 108 and the second pendant 112 are disconnectably clasped onto the necklace body 102, and more specifically, to one or more links forming a chain of the necklace body 102, such that the first and second pendants 108 and 112 are non-slidable relative to the necklace body 102. In the non-limiting example of FIG. 9, both the first pendant 610 and the second pendant 620 are disconnectably clasped onto and over the necklace body 602, and are slidable relative to the necklace body 602. The illustration of FIG. 10 shows a customizable necklace system 700, which is generally similar to the customizable necklace system 600 of FIG. 9, but is different in that a first pendant 710 and a second pendant 720 are both slidably and non-disconnectably attached to the necklace body 602, such as by a respective ring.

As mentioned heretofore, the number and appearance of the pendants included in the customizable necklace system may vary. For example, the customizable necklace system may include pendants having different shapes. One example of this is shown in FIG. 1, where the first pendant 112 is shaped differently to the second pendant 108. Examples of this are also provided in FIGS. 9 and 10. Alternatively or additionally, the pendants may have the same or different size. Alternatively or additionally, the pendants may have the same or different length; for example, the first and second pendants 108 and 112 (FIG. 1), the first and second pendants 710 and 720 (FIG. 10), and the first pendant 610 (FIG. 9) are generally short, while the second pendant 620 (FIG. 9) is generally long, i.e. longer than the first pendant 610 which is used in combination with said second pendant 620. The different possible configurations of the pendant(s) may be combined in any applicable way, allowing to obtain a myriad of necklace customizations, particularly when combined with different placements of the first and second fasteners relative to the necklace body.

With reference to the assembly steps described heretofore, although the drawings may show a specific order of executing the process steps, the order of executing the steps may be changed relative to the order shown in certain embodiments. Furthermore, two or more steps shown in succession may be executed concurrently or with partial concurrence in some embodiments. Steps may also be omitted for the sake of brevity. In some embodiments, some or all the process steps may be combined into a single process.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A customizable necklace system, comprising:

a necklace body formable into a closed loop; and a first fastener and a second fastener, configured to disconnectably fasten to one another, wherein at least one of the first and second fasteners is disconnectably attachable to the necklace body at different positions along the necklace body; wherein the customizable necklace system is configured to adopt at least two usage configurations in which the first fastener is attached to and carried by the necklace body and the second fastener is attached to and carried by the necklace body at different position along the necklace body than the first fastener, and in which the first and second fasteners are fastened to one another dividing the closed loop into a corresponding first loop and second loop, wherein, in each usage configuration:

at least one of the first fastener and the second fastener is arranged in a different position along the necklace body relative to the other usage configuration or configurations, the first loop has a different size than the size of the first loop corresponding to the other usage configuration or configurations, the second loop has a different size than the size of the second loop corresponding to the other usage configuration or configurations, and the first and second fasteners are disconnectable from one another such that the first fastener remains attached to and carried by the necklace body and the second fastener remains attached to and carried by the necklace body.

2. The customizable necklace system of claim 1, wherein the first and second fasteners are configured to magnetically fasten to one another.

3. The customizable necklace system of claim 1, wherein said at least one of the first and second fasteners which is disconnectably attachable to the necklace body comprises a clasp configured to disconnectably clasp to the necklace body at different positions along the necklace body.

4. The customizable necklace system of claim 1, wherein the first and second fasteners form an elongated link when disconnectably fastened to one another.

5. The customizable necklace system of claim 4, wherein, in the at least two usage configurations, the first and second fasteners are attached to the necklace body at opposite longitudinal ends of the link.

6. The customizable necklace system of claim 5, wherein said at least one of the first and second fasteners which is disconnectably attachable to the necklace body comprises a clasp configured to disconnectably clasp to the necklace body at different positions along the necklace body, and further wherein, in the at least two usage configurations, said at least one of the first and second fasteners is clasped to the necklace body at a longitudinal end of the link.

7. The customizable necklace system of claim 5, wherein both the first fastener and the second fastener are disconnectably attachable to the necklace body, and further wherein each one of the first and second fasteners comprises a respective clasp configured to disconnectably clasp to the necklace body at different positions along the necklace body, wherein, in the at least two usage configurations, the first and second fasteners are clasped to the necklace body at opposite longitudinal ends of the link.

8. The customizable necklace system of claim 4, wherein, in the at least two usage configurations, the first and second fasteners are disconnectably fastened to one another at an intermediate longitudinal section of the link.

9. The customizable necklace system of claim 8, wherein the first fastener and second fastener are disconnectably and magnetically fastened to one another at the intermediate longitudinal section of the link.

10. The customizable necklace system of claim 9, wherein the first fastener and second fastener comprise a respective end surface, the end surface of the first fastener configured to abut against the end surface of the second fastener when the first and second fasteners are attached to one another.

11. The customizable necklace system of claim 10, wherein the end surfaces are flat.

12. The customizable necklace system of claim 10, further comprising one or more magnets configured to magnetically attach the first fastener to the second fastener, the one or more magnets arranged at the end surface of at least one of the first and second fasteners and flush with said end surface.

13. The customizable necklace system of claim 1, further comprising a first pendant carried by the necklace body at a first position along the necklace body, respectively, wherein:

in a first usage configuration of the at least two usage configurations, the first pendant is arranged in the first loop corresponding to the first usage configuration; and in a second usage configuration of the at least two usage configurations, the first pendant is arranged in the first loop corresponding to the second usage configuration.

14. The customizable necklace system of claim 13, further comprising a second pendant carried by the necklace body at a second position along the necklace body different than the first position, wherein:

in the first usage configuration of the at least two usage configurations, the second pendant is arranged in the second loop corresponding to the first usage configuration; and in the second usage configuration of the at least two usage configurations, the second pendant is arranged in the second loop corresponding to the second usage configuration.

15. The customizable necklace system of claim 14, wherein the second pendant is different than the first pendant.

16. The customizable necklace system of claim 1, wherein the necklace body comprises at least one of a string, a cord, a strap, a band, a chain, and a strand.

17. The customizable necklace system of claim 1, wherein the necklace body comprises a plurality of ornamental members arranged linearly along a length of the necklace body.

18. The customizable necklace system of claim 17, wherein the plurality of ornamental members comprises at least one of a pearl, a bead, a precious stone, a semi-precious stone, a gold member, a silver member, and a stainless steel member.

19. A customizable necklace system, comprising:

a necklace body formable into a closed loop; and a first fastener and a second fastener, configured to disconnectably fasten to one another, wherein each one of the first and second fasteners is independently and disconnectably attachable to the necklace body at different positions along the necklace body; wherein the customizable necklace system is configured to adopt at least two usage configurations in which the first fastener is attached to and carried by the necklace body and the second fastener is attached to and carried by the necklace body at different position along the necklace body than the first fastener, and in which the first and second fasteners are fastened to one another dividing the closed loop into a corresponding first loop and second loop, wherein, in each usage configuration:

at least one of the first fastener and the second fastener is arranged in a different position along the necklace body relative to the other usage configuration or configurations, the first loop has a different size than the size of the first loop corresponding to the other usage configuration or configurations, the second loop has a different size than the size of the second loop corresponding to the other usage configuration or configurations, and the first and second fasteners are disconnectable from one another such that the first fastener remains attached to and carried by the necklace body and the second fastener remains attached to and carried by the necklace body.

20. A customizable necklace system, comprising:

a necklace body formable into a closed loop; and a first fastener and a second fastener, configured to disconnectably fasten to one another, wherein each one of the first and second fasteners is independently, magnetically and disconnectably attachable to the necklace body at different positions along the necklace body; wherein the customizable necklace system is configured to adopt at least two usage configurations in which the first fastener is attached to and carried by the necklace body and the second fastener is attached to and carried by the necklace body at different position along the necklace body than the first fastener, and in which the first and second fasteners are fastened to one another dividing the closed loop into a corresponding first loop and second loop, wherein, in each usage configuration:

at least one of the first fastener and the second fastener is arranged in a different position along the necklace body relative to the other usage configuration or configurations, the first loop has a different size than the size of the first loop corresponding to the other usage configuration or configurations, the second loop has a different size than the size of the second loop corresponding to the other usage configuration or configurations, and the first and second fasteners are disconnectable from one another such that the first fastener remains attached to and carried by the necklace body and the second fastener remains attached to and carried by the necklace body.

* * * * *